United States Patent [19]

Murray

[11] Patent Number: 4,856,681

[45] Date of Patent: Aug. 15, 1989

[54] DISPENSER FOR GRANULAR AND POWDERED DRY MATERIALS

[76] Inventor: Charles T. Murray, 1214 Overton Dr., Box 93, Lawrenceville, Ga. 30245

[21] Appl. No.: 237,785

[22] Filed: Aug. 29, 1988

[51] Int. Cl.[4] ..... B67D 5/38; G01F 11/14

[52] U.S. Cl. ..... 222/158; 141/372; 222/181; 222/243; 222/561

[58] Field of Search ..... 222/181, 185, 243, 244, 222/559, 361, 561, 362, 158; 141/360, 362, 372, 373

[56] References Cited

U.S. PATENT DOCUMENTS

| | | | |
|---|---|---|---|
| 169,113 | 10/1875 | Mainer | 222/243 X |
| 1,405,197 | 1/1922 | Franke | 141/372 |
| 1,455,970 | 5/1923 | Resek | 222/181 X |
| 1,485,032 | 2/1924 | Janes | 222/561 |
| 1,851,044 | 3/1932 | Genovesi | 222/232 X |
| 2,110,252 | 3/1938 | Wolcott | 141/373 X |
| 2,410,410 | 11/1946 | Garubo | 222/243 X |
| 2,551,765 | 5/1951 | Sedor | 222/561 X |
| 2,626,089 | 1/1953 | Osfar | 222/561 X |
| 2,827,083 | 3/1958 | Cortner | 222/561 X |
| 3,067,591 | 12/1962 | Lingle | 222/239 X |
| 3,344,958 | 10/1967 | Kaanehe | 222/181 |
| 3,602,394 | 8/1971 | McCune | 222/240 X |
| 4,023,602 | 5/1977 | Sparr, Sr. | 222/181 X |
| 4,079,867 | 3/1978 | Tannehill | 222/368 |
| 4,176,767 | 12/1979 | Franche, IV | 222/243 |
| 4,243,158 | 1/1981 | Negosta | 222/564 X |
| 4,349,128 | 9/1982 | Sanfilippo | 222/559 X |

FOREIGN PATENT DOCUMENTS

| | | | |
|---|---|---|---|
| 66422 | 12/1982 | European Pat. Off. | 222/559 |
| 2260635 | 6/1974 | Fed. Rep. of Germany | 222/362 |
| 186751 | 12/1936 | Switzerland | 222/559 |

*Primary Examiner*—Kevin P. Shaver

*Attorney, Agent, or Firm*—Hurt, Richardson, Garner, Todd & Cadenhead

[57] ABSTRACT

A dispenser for granulated materials and powdered materials is disclosed having a hopper contained within a base mounting which dispenses material to a receiving cup. A manually operated sliding plate valve starts and stops the flow of material into the cup. Overflow is prevented by maintaining the receiving cup within close proximity to the mounting via runners extending from the top of the cup. Both the cup runners and sliding plate are slidably held adjacent the mounting via interior and exterior channels attached thereto.

6 Claims, 1 Drawing Sheet

DISPENSER FOR GRANULAR AND POWDERED DRY MATERIALS

BACKGROUND OF THE INVENTION

1. Field of the Invention

This invention relates to a dispenser for granular or powdered material for use in storing and releasing free flowing materials such as sugar, salt, soap powder and the like for a variety of household and industrial applications.

2. Description of the Prior Art

The dispensation of granulated and powdered dry materials has inherently characteristic problems to which the present invention is addressed. Powdered and granular materials such as soap, sugar, salt, flour, etc. are natural absorbers of moisture in the air. When absorption occurs, the material becomes clumped and/or hard and does not dissolve easily in water or mix well with other ingredients. Clumped material is also more difficult to dispense. Thus, a dispenser for granular or powdered materials is needed which will not clog and will aid in free flowing dispensation.

Another problem associated with dispensing granular and powdered materials is that because such materials are often very free flowing, many dispensers allow for overflow into the receiving container. A dispenser is needed which will regulate the free flow of granulated or powered material into a receiving cup to prevent overflow. There are several prior art references which are known to the applicant which dispense granular or powder materials, however, none of these adequately meet all of the objectives of the present inventions.

For instance known to the applicant is Osfar, U.S. Pat. No. 2,626,089. Osfar discloses a powdered and granulated material container having a spring operated closing valve. The invention discloses a flat plate valve with a spring attachment, but has no mechanism for keeping granular material from clotting.

U.S. Pat. No. 4,176,767 to Franche VI discloses a dog food dispenser with a sliding gate for regulating the flow of dog food and an extension into its hopper for food agitation. A dog food dish is placed underneath the dispenser and the flow of food is regulated manually. Thus there is potential for dispensing food to overflow from the receiving container as food flows continuously until the sliding gate is manually closed.

Also known to the applicant is Orton, U.S. Pat. No. 4,026,442. Orton discloses a household liquid dispenser which utilizes a spring loaded sliding gate to dispense liquid from a hopper. The hopper has a release hole in the bottom, which is opened and closed by the sliding gate. As an extension from the sliding plate is depressed, a channel within the sliding plate is aligned with the release hole in the bottom of the hopper. Liquid enters the channel and travels downward to a dispensing spout also aligned with the channel at its lower end. This apparatus is only useful for extremely free-flowing materials such as liquid due to its path of dispensation which is partially horizontal. As more liquid is dispensed into the channel, liquid in the dispensation channel is forced onward.

Similar to Orton, but more appropriate for powder dispensation, is the spring activated tooth powder dispenser shown in Stone, U.S. Pat. No. 2,556,826. Stone discloses a toothbrush inserted in a channel. The toothbrush is pressed against a spring activated sliding plate. Tooth powder is dispensed onto the toothbrush by gravity through a dispensing channel opened and cleared by a hole in the sliding gate. In order to continue dispensation, pressure must be maintained against the sliding gate. The hopper has no means of preventing clotting or clumping of the material contained within the hopper.

Kaanehe, U.S. Pat. No. 3,344,958, discloses a dry product dispenser having a hopper and funnel for dispensation blocked by a spring loaded sliding valve. The valve must be held open manually in order to dispense material. No means is included to break up clotted material before dispensation.

No prior art is known that meets all of the objectives of the present invention, that is, to provide a dispenser for granular or powdered dry materials in a free-flowing manner, which has the combined features of providing a means for preventing clumping of the material inside the hopper, avoiding overflow of the material in the recipient container and is cheap to manufacture, due to a simple design and a minimal number of parts.

SUMMARY OF THE INVENTION

It is therefore an object of the present invention to provide a dispenser for granulated and powdered dry materials which is inexpensive to manufacture and is durable.

It is another object of the present invention to provide a dispenser for granulated and powdered materials which ceases to dispense materials when the receiving container is filled to capacity.

It is a further object of the invention to provide a dispenser for granulated materials which contains a means for preventing and breaking up clumped or clotted materials which inhibit free dispensation.

It is yet another object of the invention to provide a dispenser for granulated or powdered material that will freely and completely empty itself of contained material without the need to maintain contact with the valve used for dispensing.

The preferred embodiment of the dispenser for granular material as described herein is characterized by a vertical cylindrical dispensing hopper of a transparent material opened at the top to allow entry of a larger volume of granular or powdered material. A funnel is attached to the bottom of the hopper for directing material downward to be dispensed and rests within a mounting which is contoured to the shape of the funnel on the inside. The mounting has at least two parallel "T" shaped rods attached to its bottom side which form a series of parallel channels. The mounting also has a hole which meets with the funnel hole from which granular material is dispensed, and a sliding valve underneath the mounting to stop and start flow from the hopper through the funnel hole. The valve is essentially a plate held in place by the interior channels formed underneath the mounting. A cup for receiving dispensed material is releasably held directly underneath the mounting by a pair of parallel runners which extend from opposite sides of the top of the cup, and slide along the outer channels formed by the T-shaped mounting rods. An agitator for breaking up clumped material inside the hopper extends from the sliding valve perpendicularly into the funnel and hopper. The agitator also serves as a stop means for limiting the movement of the sliding valve.

Other advantages of the dispenser for granular material will become apparent from the detailed description of the invention provided below.

DETAILED DESCRIPTION OF THE PREFERRED EMBODIMENT

Figure 1:
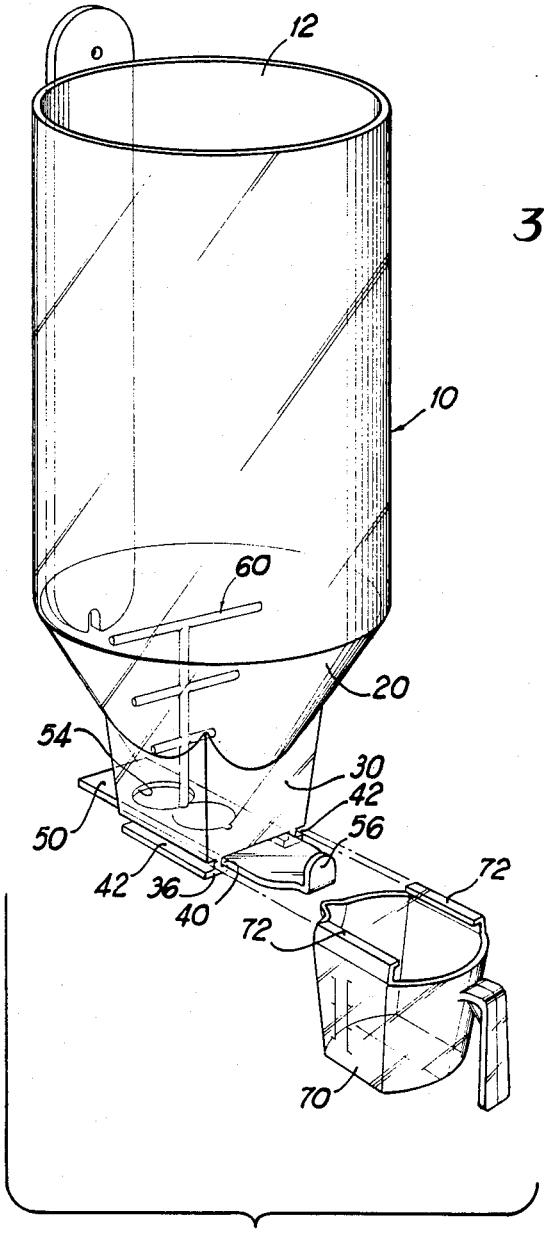
FIG. 1 is a perspective view of a dispenser for granulated material made in accordance with the present invention with the receiving cup removed.
Figure 2:
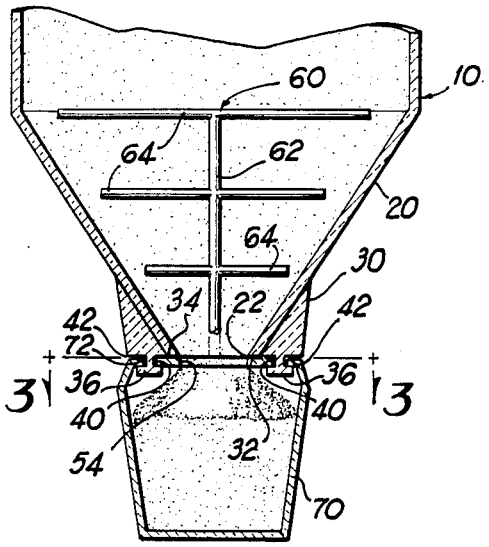
FIG. 2 shows a vertical cross-sectional view of the dispenser for granulated material with the receiving cup attached.
Figure 3:
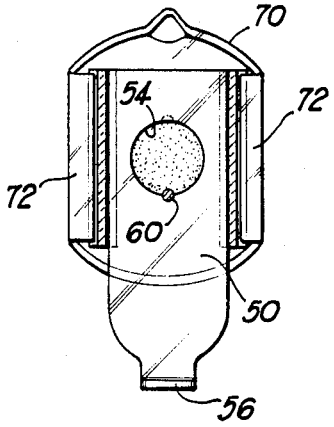
FIG. 3 shows a cross-sectional view of the dispenser for granulated material taken along line 3—3 in FIG. 2 with the sliding valve in a closed position.
Figure 4:
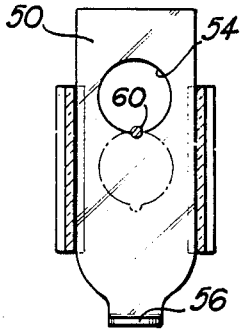
FIG. 4 shows a cross-sectional view of the dispenser for granulated material taken along line 3—3 in FIG. 2 with the sliding valve in an open position.

A preferred exemplary embodiment of the invention is illustrated in FIGS. 1–4 wherein like numerals represent like parts. The dispenser for granulated material is comprised of a hopper (10), which has an open top (12), so that it may be filled with large portions of material to be dispensed by the invention. The hopper (10) gradually narrows in diameter to form a funnel shaped bottom portion (20), which tapers to a hole (22) in the bottom of the funnel (20). The funnel hole (22) diameter is much smaller than the top open end (12) of the hopper (10).

The funnel portion (20) of the hopper (10) rests inside a mounting (30). The mounting (30) has an interior shape which tapers to conform to the funnel (20). The bottom of the mounting is a planar surface (32) with a circular mounting hole (34) cut in the center of the bottom of the mounting. The funnel (20) rests within the mounting (30) so that the funnel hole (22) matches with the mounting hole (34) to dispense material held within the hopper (10).

Extending from the planar bottom (32) of the mounting are two T-shaped rods (36) placed generally parallel to each other on either side of the mounting hole (34). The T-shaped rods are mounted so that the flat portion of the "T" hangs upside down when extending from the planar bottom of the mounting (32). The rods form two sets of channels below the mounting, an interior set of channels (40), and an exterior set of channels (42).

A sliding plate valve (50) is used to regulate the flow of granulated material from the hopper (10) through the funnel (20) and downward to the receiving cup (70). The valve (50) is essentially a flat plate in the shape of an elongated rectangle. The plate is of a width so that the plate can be inserted and held within the interior set of channels (40) formed by the "T"-shaped rods (36) next to the planar bottom surface (32) of the mounting (30). The plate has a valve hole (54) on its forward end. When the flat plate is maximally withdrawn from the interior channels (40), the valve hole (54) is aligned with the funnel and mounting holes (22) and (34). The valve hole (54) is slightly smaller in diameter than the funnel and mounting holes (22) and (34). When alignment of the valve hole (54) with the funnel hole (22) and mounting hole (34) occurs, the dispenser releases material contained within the hopper (10). The remaining portion of the flat plate (52), exclusive of valve hole (54), is a solid flat sheet of material. When the valve plate (50) is maximally inserted within the interior set of channels (40), the dispenser is closed by blocking the funnel hole (22) and mounting hole (34), with the solid plate portion of the valve (50). A handle (56) extends from the valve (50) for ease in operating the dispenser.

Extending from the valve plate (50) from a point along the perimeter of the valve hole (54) in the center most portion of the plate, an agitator (60) extends perpendicularly up through the mounting (30) and funnel portion (20) of the hopper (10). The agitator (60) serves two purposes. First, it provides a stop means in either direction for the valve plate (50). As the valve plate is pushed forward to terminate dispensation, the agitator (60) hits the interior edge of the funnel wall (20) as well as the rim of the funnel hole (22). As the valve plate is pulled out to release material, the agitator (60) meets the opposite interior wall of the funnel (20) and rim of the funnel hole (22). Thus, movement of the valve plate (50) is limited to the distance of the diameter of the funnel hole (22) and cannot be removed from the dispenser in either direction within the interior channels (40).

As a second utility, the agitator (60) serves to break up clumped material within the funnel (20). The agitator (60) is essentially a vertical pole (62) with cross bars (64) perpendicularly attached to the vertical pole (62). The cross bars (64) increase in length as they are attached at points higher up along the vertical pole (62) within the funnel (20). Each cross bar (64) extends to a length, which is slightly shorter than the diameter of the funnel (20), at the point on a vertical axis where the cross bar (64) traverses the funnel (20). Each time the sliding valve (50) is opeated, material inside the funnel is broken up by movement of the agitator (60).

Material from the hopper (10) is dispensed into a receiving cup (70). Cup capacity can vary with the desired amount of dispensed material. The receiving cup (70) has a pair of parallel inwardly-turned runners (72) extending from opposite sides of the top of the cup. The runners (72) are spaced and shaped so that they grasp and slide within the exterior channels (42) formed by the T-shaped rods extending from the planar bottom (32) of the mounting (30). Thus, the receiving cup (70) is held directly underneath the mounting (30) and funnel (20) and slides on and off by inserting the runners (72) into the exterior set of channels (42) and withdrawing them.

In order to fill the receiving cup (70), the cup is slides into place underneath the mounting (30). The sliding valve (50) can then be manually opened to release material from the hopper (10) into the cup. Material freely flows downward by the force of gravity as the valve (50) is opened. The receiving cup (70) is maintained via the runners (72) and channels (42) within close proximity to the dispensing valve hole (54). Overflow of material from the receiving cup is not possible since the close proximity from the cup (70) to the valve (50) when the receiving cup is secured to the mounting (30) acts as a natural stop to the flow of material.

A mound of dispensed material forms at the top edge of the cup between the cup (70) and valve (50). The valve (50) can then be pushed closed. This smooths the top of the mound of material form from dispensation. Thus, a regulated amount of material predetermined by the size of the receiving cup (70) is released by simply allowing the free flow of material. Lesser amounts of material can be dispensed by simply closing the valve (50) before the cup (70) is filled.

Many alterations are anticipated within the scope of the invention described. The granular dispenser can be made out of a number of materials including plastic, metal, or any combination of materials, and may be made of a translucent or transparent material. A cover (not shown) may be placed over the top (12) of the hopper so as to protect material to be dispensed from dust and other foreign objects.

As seen from the foregoing description, the dispenser for granulated material provides advantages over previously known dispensers in its unique form and combination of characteristics. It is to be understood that the form of the invention herewith shown and described is to be taken as a preferred example of the same, and that various changes in shape, size, material, arrangement, and assembly methods of parts may be resorted to without departing from the spirit of the invention or scope of the subjoined claims.

I claim:

1. A device for dispensing granulated and powdered materials comprising:

(a) a hopper for storing granulated or powdered material having at least one continuous wall and a large open top for receiving material and a bottom portion which tapers to a opening narrower than the top opening for releasing said material contained in said hopper;

(b) a mounting for supporting said hopper said mounting having a top portion which receives the bottom portion of said hopper therein, and a bottom surface with a mounting hole cut therein at a location on the surface below the area where the narrow opening of said hopper meets said mounting;

(c) two pairs of channels one of said pairs being interior channels and the other of said pairs being exterior channels extending along the bottom surface of said mounting with one of the channels of each of said pairs of channels located generally parallel to the other channel on opposite sides of said mounting hole, with each of said pairs being generally parallel to the other pair of channels, said interior channels and said exterior channels being disposed in the same horizontal plane;

(d) a sliding valve plate having a valve hole in said plate, said sliding valve plate having a width approximately equal to the distance formed between said interior channels such that said sliding valve plate is supported on each side by one of said interior channels and is slidably moveable between said interior channels; and (e) a receiving cup for catching material from said hopper as it is dispensed having a pair of runners extending generally parallel to each other and above said cup, said runners being spaced apart from each other at a distance approximately equal to the distance between the vertical walls of said exterior channels wherein said runners are received by and slidably moveable between said exterior channels, holding said cup within close proximity to said mounting but at sufficient distance from said mounting such that said sliding valve plate may move freely within said interior channels without interference from said cup disposed below.

2. A device for dispensing granulated and powdered materials as defined in claim 1, further comprising an agitator attached to said sliding valve plate at a point on the sliding plate adjacent to said valve hole and extending vertically through said mounting hole and into said tapered portion of said hopper.

3. A device for dispensing granulated and powdered materials as defined in claim 2, wherein said agitator is comprised of a base rod vertically positioned relative to said sliding plate, and a plurality of cross bars attached perpendicularly to said vertical base rod at spaced locations along said rod.

4. A device for dispensing granular and powdered material as defined in claim 3, wherein the length of each of said cross bars correlates proprtionally to the diameter of the hopper at the point where each cross bar traverses said hopper such that each cross bar maximally extends across said hopper without contacting the interior wall of said hopper.

5. A device for dispensing granulated and powdered materials as defined in claim 1, wherein said device is constructed of a transparent material.

6. A device for dispensing granulated and powdered dry materials comprising:

(a) a hopper having a top end and a bottom end for storing said dry materials which is opened at its top end and tapers to a smaller opening at its bottom end;

(b) a mounting for supporting said hopper therein having a top portion for receiving said hopper and a bottom surface with a mounting hole placed therein which aligns with said bottom opening of said hopper, said bottom surface having four parallel channels attached thereto, said channels being located along the same horizontal plane, two of said channels located on one side of said mounting hole and two of said channels located on the opposite side of said mounting hole such that two of the channels form a pair of interior channels about said mounting hole and the other two channels form an exterior pair of channels about said mounting hole;

(c) a sliding valve plate having a valve opening therein and a valve handle at one end wherein said sliding valve plate is slidable back and forth underneath said mounting hole between said interior channels serving to open the hopper for dispensation when said valve hole aligns with said mounting hole and close the hopper when the valve hole is not aligned with the mounting hole;

(d) an agitating means mounted on said sliding valve plate at a location adjacent to said valve hole and extending into the interior of said hopper for agitating said dry material stored within said hopper, each time said sliding valve plate is operated; and (e) a receiving cup with substantially parallel runners extending above said cup which are receivable within the exterior pair of channels under said mounting for holding said cup within close proximity but below said mounting allowing said sliding valve plate to move within said interior channels without interference from said receiving cup.

* * * * *